US005324179A

United States Patent [19]

Nakagawa

[11] Patent Number: 5,324,179

[45] Date of Patent: Jun. 28, 1994

[54] MOTOR PUMP WITH A TREATING LIQUID CIRCULATION SYSTEM

[75] Inventor: Yuzo Nakagawa, Tokyo, Japan

[73] Assignee: Nikkiso Co., Ltd.

[21] Appl. No.: 979,194

[22] Filed: Nov. 20, 1992

[30] Foreign Application Priority Data

Nov. 21, 1991 [JP] Japan ..... 3-306072

[51] Int. Cl.[5] ..... F04B 17/00

[52] U.S. Cl. ..... 417/423.8; 417/366; 417/369

[58] Field of Search ..... 417/423.8, 366, 368, 417/369

[56] References Cited

U.S. PATENT DOCUMENTS

| | | | |
|---|---|---|---|
| 3,443,519 | 5/1969 | White | 417/423.8 |
| 3,637,329 | 1/1972 | Sato et al. | 417/423.8 |
| 4,523,896 | 6/1985 | Lhenry et al. | 417/366 |
| 4,652,218 | 3/1987 | Tsutsui | 417/368 |
| 4,684,329 | 8/1987 | Hashimoto | 417/366 |
| 4,808,087 | 2/1989 | Tsutsui | 417/369 |

FOREIGN PATENT DOCUMENTS

| | | | |
|---|---|---|---|
| 0148996 | 11/1980 | Japan | 417/369 |
| 0148997 | 11/1980 | Japan | 417/369 |

*Primary Examiner*—Richard A. Bertsch
*Assistant Examiner*—Alfred Basichas
*Attorney, Agent, or Firm*—Davis Hoxie Faithfull & Hapgood

[57] ABSTRACT

In a motor pump where the cooling of the motor section and the lubrication of bearings are achieved by an independent circulation system of a treating liquid by an auxiliary impeller, the pressure of a motor section, that is, the pressure of the treating liquid circulating is raised more than the suction pressure of a main process (the suction pressure of a main impeller). The treating liquid circulating from a front rotor chamber is caused to flow through a passage into an inlet port which is separated radially outside by a selected distance L from a suction inlet portion of the auxiliary impeller. This raises the pressure at the inlet port (the pressure of the front rotor chamber) to a pressure which is higher than the pressure at the suction inlet port by a magnitude corresponding to the distance L. Thus, even for a liquid which is at a high temperature and liable to be gasificated, it is possible to prevent the gasification of the circulating liquid to thereby achieve the cooling of the motor section and the lubrication of the bearings in a smooth fashion.

4 Claims, 4 Drawing Sheets

MOTOR PUMP WITH A TREATING LIQUID CIRCULATION SYSTEM

BACKGROUND OF THE INVENTION

The present invention relates to a motor pump, and more particularly to a canned motor pump having a circulation system for a treating liquid circulating within a rotor chamber of a canned motor section for cooling the motor section and for lubricating its bearing.

In general, a canned motor pump is, as shown in FIG. 2, essentially comprises a pump section 16 and a canned motor section 22. The pump section 16 includes a casing 10, a main impeller 12 and a liner disc 14. The canned motor section 22 includes a stator assembly 18 and a rotor assembly 20. Both the pump section 16 and the canned motor section 22 are connected by adaptor 24. The main impeller 12 and the rotor assembly 20 are respectively mounted on a rotor shaft 32 which is supported by a liner ring 26, a front bearing 28 and a rear bearing 30.

In such canned motor pumps, the rotor shaft 32 is not sealed. Then, the treating liquid of the canned motor pump serves to cool the motor section 22 and to lubricate the front and rear bearings 28 and 30. With respect to canned motor pumps resistive to a hot treating liquid, the circulation of the treating liquid for cooling the motor section 22 and lubricating the front and rear bearings 28 and 30 are achieved by an auxiliary impeller 38 independent of the main impeller 12. The auxiliary impeller 38 is provided on a side of a front rotor chamber 34 involved in the motor section 22. Thus, the auxiliary impeller 38 serves for making the pressure of the treating liquid rise. Then, the treating liquid is circulated through a pipeline 40, a cooler 42, a pipeline 44, a liquid reservoir 46, a passage 48 and a surface of the rear bearing 30, a rear rotor chamber 36, the front rotor chamber 34, a passage 50 and a surface of the front bearing 28 and thus back to the auxiliary impeller 38. As a result of those, the cooling for the motor section 22 and lubricating for the front and rear bearings 28 and 30 are achieved.

Although such circulation of the treating liquid for cooling and lubricating operations are achieved by the auxiliary impeller 38 independent of the main impeller 12, such circulation system is poor in reliability, especially to a high temperature treating liquid which is likely to be gasified.

In FIG. 3 showing the auxiliary impeller 38 section, the treating liquid in the front rotor chamber 34 is transmitted to a suction inlet port 52 of the auxiliary impeller 38 through the passage 50 and the bearing surface of the front bearing 28. In the auxiliary impeller 38, the pressure of the treating liquid is raised and discharged through a discharging port 54. With respect to the pressure of the treating liquid, since the suction inlet port 52 communicates with a suction inlet port of the main impeller 12 through passage 56 and the liner ring 26 (see FIG. 2), a suction pressure of the treating liquid at the suction inlet port 52 is so set as to be approximately equivalent to a suction pressure of the treating liquid at the main impeller 12, and thus in a main process (hereinafter referred to as a main process suction pressure).

Further, the pressure of the treating liquid in the rotor chamber, particularly in the front rotor chamber 34 directly communicating with the suction inlet port 52 through the passage 50 is also so set as to be approximately equivalent to the suction pressure of the main process. In case that the treating liquid is a high temperature and liable to be gasified, if the treating liquid cooled by the cooler 42 becomes a higher temperature than a predetermined value, the circulating treating liquid is readily gasified. Therefore, the problems with the conventional cooling and lubricating system are that the gasification of the circulating treating liquid prevents the cooling of the motor section and the lubrication of the bearing. Further, the gasification of the circulating treating liquid causes cavitation, erosion and other affections, when bubbles produced by the gasification burst.

SUMMARY OF THE INVENTION

Accordingly, it is a primary object of the present invention to provide a motor pump including an improved circulation system for a treating liquid circulating within a motor section which is capable of preventing a gasification of the treating liquid due to a high temperature.

The above and other objects, features and advantages of the present invention will be apparent from following descriptions.

In order to achieve the above object, a motor pump having an additional treating liquid circulation system including an auxiliary impeller provided on a side of the front rotor chamber of the motor section for cooling the motor section and for lubricating its bearings is characterized in that an inlet port into the auxiliary impeller for the treating liquid circulating within the rotor chamber is provided in the radial direction outside a suction inlet port of the auxiliary impeller so that a pressure of the treating liquid within the rotor chamber is raised more than a pressure of the treating liquid at the suction inlet port of the auxiliary impeller.

Further, it is preferable to provide a shroud having a predetermined diameter, which is provided to the auxiliary impeller between on a side of the inlet port and the suction inlet port of the auxiliary impeller for the treating liquid which circulates within the rotor chamber.

The inlet port of the auxiliary impeller for circulating the treating liquid is provided in the radial direction outside the suction inlet port of the auxiliary impeller. As a result of those, the pressure of the treating liquid circulating within the rotor chamber is higher than the suction pressure of the auxiliary impeller, and thus the suction pressure of the main process.

In case that the shroud is provided to the auxiliary impeller on the side of the inlet port and the suction inlet port, the rise in the pressure of the treating liquid circulating in the rotor chamber may suitably be adjusted.

PREFERRED EMBODIMENTS OF THE INVENTION

Preferred embodiments of a motor pump according to the present invention will hereinafter fully be described in detail with reference to the accompanying drawings.

Figure 1:
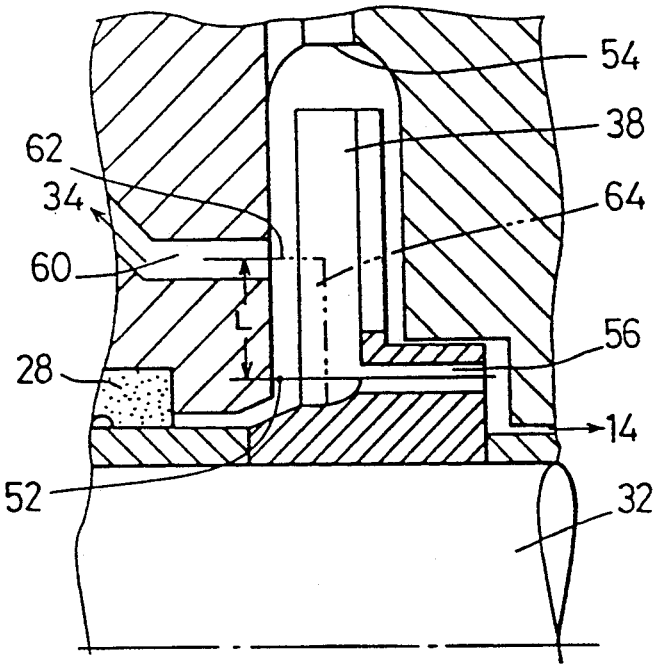
FIG. 1 is a cross sectional view showing a structure of an auxiliary impeller section involved in a motor section of the motor pump according to the invention.
Figure 2:
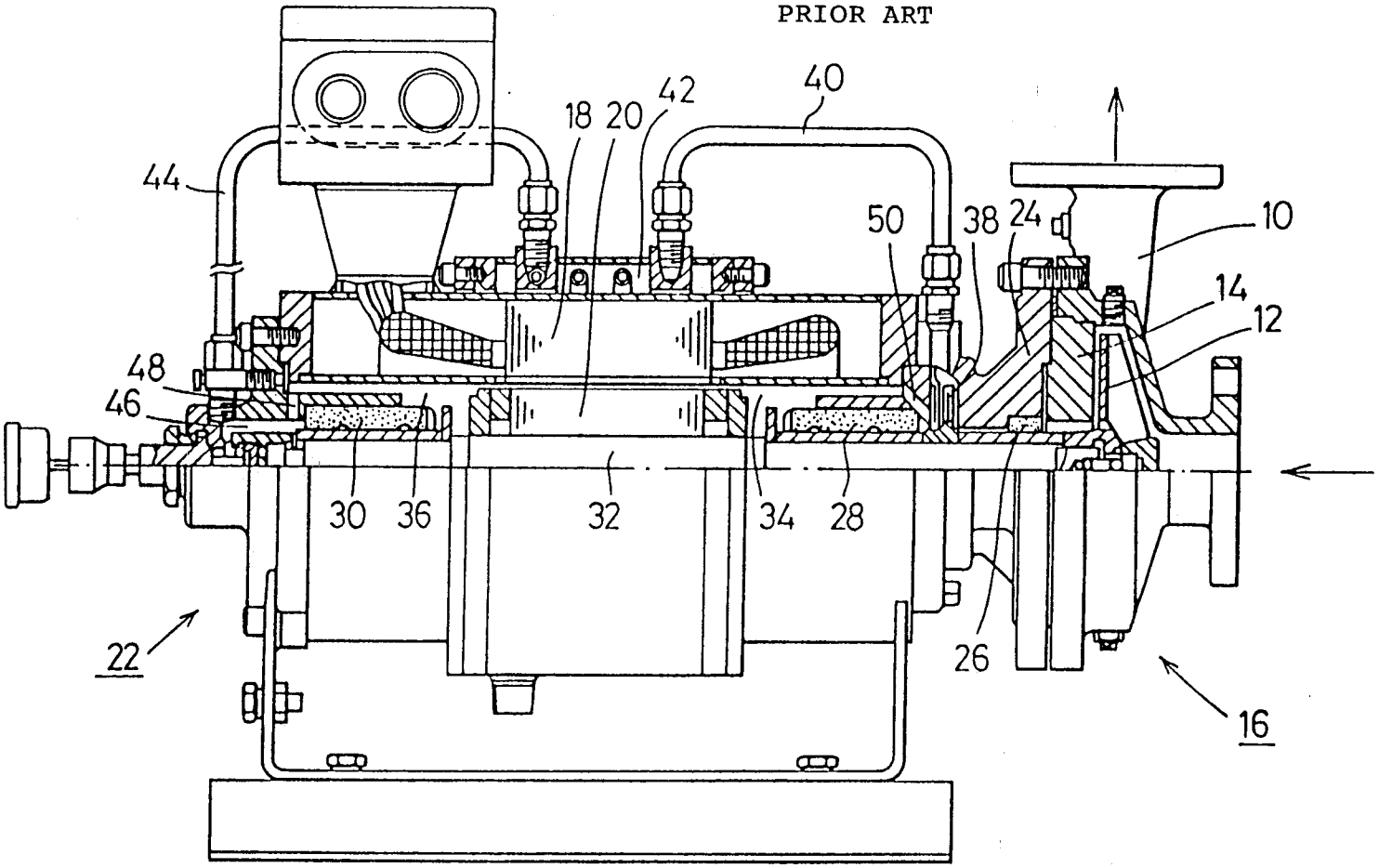
FIG. 2 is a cross sectional view showing a structure of a canned motor pump for treating a high temperature liquid which is poor in a heat resistance.
Figure 3:
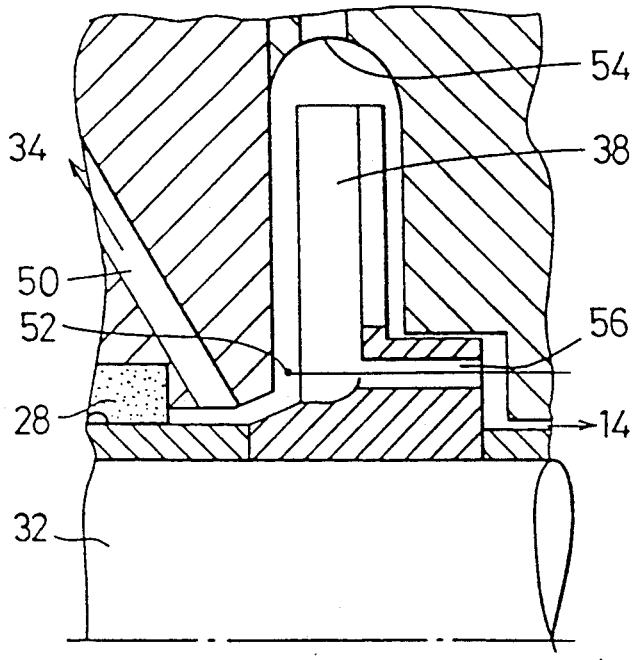
FIG. 3 PRIOR ART
FIG. 3 is a cross sectional view showing the structure of the conventional auxiliary impeller involved in a motor pump.

In FIG. 1, an auxiliary impeller section 38 is so constructed that a treating liquid transmitted from a front rotor chamber 34 flows into an inlet port 62 through the passage 60, and thus into an outside position separated at a predetermined distance L from a suction inlet port 52 of the auxiliary impeller 38. Further, a small deal of the treating liquid flows directly into the suction inlet port 52 through the bearing surface of the front bearing 28.

The treating liquid around the auxiliary impeller 38 has a profile in pressure corresponding to a pressure profile possessed by a normal forced swirling motion of the treating liquid by general open radial blades. Thus, the pressure of the treating liquid at the inlet port 62 is higher than the pressure of the treating liquid at the suction inlet port 52, and thus the suction pressure of the main process (the suction pressure of the main impeller 12) by a pressure difference of the treating liquid generated by the distance L. Accordingly, the pressure of the treating liquid within the front rotor chamber 34 communicating with the inlet port 62 through the passage 60 is also raised at least by the same pressure difference as the above pressure difference value. As a result of those, the treating liquid circulating in the rotor chamber is free from any gasification.

Figure 4:
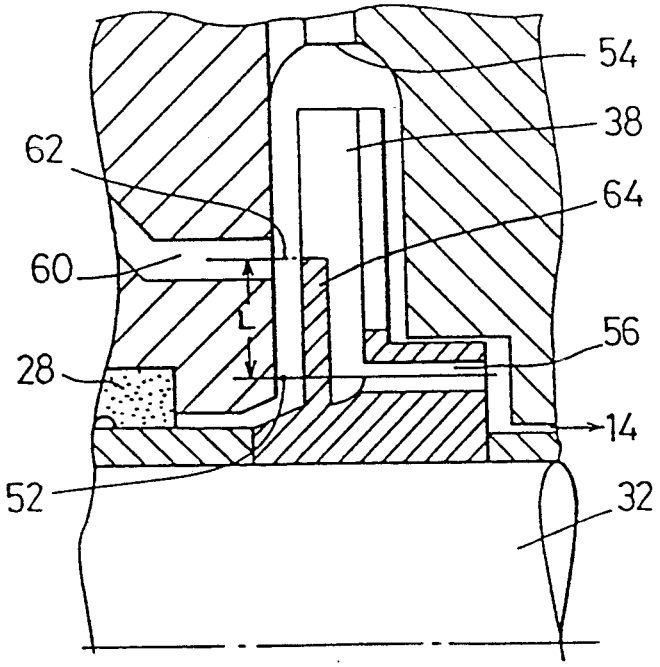
FIG. 4 is a cross sectional view showing a structure of an auxiliary impeller section and shroud involved in a motor section of the motor pump according to the invention.

It is permissive that a deal of the rise in the pressure of the treating liquid may be adjusted by selecting the location of the inlet port 62, and thus by setting the predetermined distance L. It is further available that the adjustment of a deal of the rise in the pressure of the treating liquid may also be achieved by adjusting a diameter of the shroud 64 corresponding to the variable distance L as shown in FIG. 4. Shroud 64 is also shown in phantom in FIG. 1. This allows preventing an extreme large gradient of the pressure of the treating liquid within the rotor chambers 34 and 36.

Thus, the present invention is able to present a high temperature treating liquid which is liable to be gasified from any gasification thereby freeing the treating liquid from the cavitation. Thus, the present invention possesses a desirable cooling function for the motor section and lubricating function for the bearings.

Needless to say, the present invention is applicable to not only the above type of the canned motor pump but other types of motor pumps, for example, a slurry separation type canned motor pump in which a clean mother treating liquid is supplied to a circulating treating liquid, a canned motor pump having an independent circulating system and a motor pump without can.

Whereas modifications of the present invention will no doubt be apparent to a person of ordinary skill in the art, it is to be understood that the embodiments shown and described by way of illustration are by no means intended to be considered in a limiting sense. Accordingly, it is to be intended by the claims to cover all modifications of the invention which fall within the spirit and scope of the invention.

I claim:

1. A motor pump having an independent treating liquid circulation system including an auxiliary impeller provided on a side of a front rotor chamber of a motor section for cooling said motor section and for lubricating its bearings, characterized in that an inlet port of said auxiliary impeller for said treating liquid circulating within rotor chambers is provided radially outside a suction inlet port of said auxiliary impeller, relative to an axis of rotation of the impeller, so that a pressure of said treating liquid within said rotor chamber is higher than a pressure of said treating liquid at said suction inlet port of said auxiliary impeller.

2. The motor pump as claimed in claim 1, wherein said auxiliary impeller is formed with a shroud having a predetermined diameter on a side of said inlet port and suction inlet port.

3. An independent treating liquid circulating system for cooling a motor section having a rotor chamber and bearings, and for lubricating the bearings with a treating liquid, comprising:

an auxiliary impeller having an axis of rotation;

an inlet port communicating said auxiliary impeller with the rotor chamber, said inlet port spaced a first radial distance from said axis; and a suction inlet port spaced a second radial distance from said axis, wherein said first radial distance is greater than said second radial distance and wherein the treating liquid within the rotor chamber is at a higher pressure than the treating liquid at said suction inlet port.

4. The apparatus of claim 3, wherein said auxiliary impeller is formed with a shroud having a predetermined diameter on a side of said inlet port and said suction inlet port.

* * * * *